US006039102A

United States Patent [19]

Sadrakula et al.

[11] Patent Number: 6,039,102

[45] Date of Patent: Mar. 21, 2000

[54] SHEET MATERIAL DISPENSER WITH SAFER SHEET CUTTING MEANS

[75] Inventors: Philip V. Sadrakula, Hudson, Wis.; Leonard Kampa, Bloomington, Minn.; Michael D. Hamerski, Baldwin, Wis.; James L. Bries, Cottage Grove, Minn.

[73] Assignee: 3M Innovative Properties Company, St. Paul, Minn.

[21] Appl. No.: 08/855,687

[22] Filed: May 14, 1997

[51] Int. Cl.[7] ..... B32B 31/00

[52] U.S. Cl. ..... 156/510; 156/523; 156/577; 156/579; 225/20; 225/72; 225/91

[58] Field of Search ..... 225/20, 47, 53, 225/91, 72; 156/250, 365, 510, 544, 579, 523, 577

[56] References Cited

U.S. PATENT DOCUMENTS

| | | | |
|---|---|---|---|
| 1,299,087 | 4/1919 | Winterhalter | 225/15 |
| 4,119,251 | 10/1978 | Golner et al. | 225/20 |
| 4,427,144 | 1/1984 | Macgrory et al. | 225/7 |
| 4,516,711 | 5/1985 | Barege | 225/20 |
| 4,586,639 | 5/1986 | Ruff et al. | 225/1 |
| 4,651,911 | 3/1987 | Kirkup et al. | 225/20 |
| 4,762,586 | 8/1988 | Wilkie | 156/527 |
| 4,826,063 | 5/1989 | Ban | 225/52 |
| 4,906,021 | 3/1990 | Rowe et al. | 280/789 |
| 4,944,441 | 7/1990 | Gana | 225/16 |
| 4,972,984 | 11/1990 | Frank et al. | 225/20 |
| 5,024,362 | 6/1991 | Karlsson | 225/20 |
| 5,161,723 | 11/1992 | Wirtz-Odenthal | 225/14 |
| 5,190,199 | 3/1993 | Bulger et al. | 225/1 |
| 5,275,073 | 1/1994 | Zemlak et al. | 83/171 |
| 5,393,367 | 2/1995 | Yu Chen | 156/523 |
| 5,791,586 | 8/1998 | Cayford et al. | 242/571.4 |

FOREIGN PATENT DOCUMENTS

| | | |
|---|---|---|
| 0 279 920 | 8/1988 | European Pat. Off. . |
| 2 173 141 | 10/1986 | United Kingdom . |
| 2 196 285 | 4/1988 | United Kingdom . |
| 2 255 925 | 11/1992 | United Kingdom . |
| WO 89/00394 | 1/1989 | WIPO . |

OTHER PUBLICATIONS

European Patent Office, Patent Abstracts of Japan, abstract for JP 60213661 published Oct. 25, 1985, Applicant Higa, Kozaburo.

*Primary Examiner*—Richard Crispino
*Assistant Examiner*—Linda L. Gray
*Attorney, Agent, or Firm*—William L. Huebsch

[57] ABSTRACT

A dispenser from which sheet material may be manually pulled from a supply of the sheet material carried on the dispenser through a passageway defined by a frame of the dispenser. The dispenser includes a cutting member having a sharp cutting edge adapted for transversely cutting the sheet material and an elongate contact surface generally parallel to and spaced from the cutting edge. The cutting member is mounted on the frame for movement between (1) a retracted position to which it is biased at which the cutting edge is positioned to restrict contact between a person using the dispenser and the cutting edge and at which the contact surface extends along the one side of the passageway; and (2) a cutting position to which the cutting member can be moved from its retracted position by manually tensioning sheet material being pulled from the dispenser around the contact surface of the cutting member. At the cutting position the cutting edge is positioned to intersect and transversely sever the tensioned sheet material being manually withdrawn from the dispenser.

12 Claims, 6 Drawing Sheets

SHEET MATERIAL DISPENSER WITH SAFER SHEET CUTTING MEANS

FIELD OF THE INVENTION

The present invention relates to dispensers with which lengths of sheet material may be manually dispensed from supplies of the sheet materials carried on the dispensers, which dispensers include cutting members having sharp cutting edges adapted for transversely cutting dispensed lengths of the sheet materials from the sheet materials remaining on the dispensers.

DESCRIPTION OF THE RELATED ART

The art is replete with dispensers with which lengths of sheet materials may be manually dispensed from supplies of the sheet materials (typically in helical rolls) that are carried on the dispensers, which dispensers include cutting members having sharp cutting edges adapted for transversely cutting dispensed lengths of the sheet materials from the supply of sheet materials remaining on the dispensers. U.S. Pat. Nos. 3,567,557; and 4,915,768 provide illustrative examples. The cutting members on some of those dispensers provide a potential source of injury for persons using the dispensers, particularly if the cutting members have sharp teeth such as those on a cutting blade described in U.S. Pat. No. 4,913,767 that is adapted to cut folded polymeric sheet material. A guard described in U.S. Pat. No. 4,989,769 has been devised for such a cutting member, however, such guards can be removed by workmen that are less concerned with safety than with the ease of using the dispenser.

SUMMARY OF THE INVENTION

The present invention provides means useful on dispensers of the types described above for transversely cutting dispensed lengths of sheet materials from supplies of the sheet materials carried on the dispensers, which means for transversely cutting protects a user of the dispenser from the cutting member between its uses to cut sheet material, while providing easy efficient severing of the sheet materials when that is desired.

According to the present invention there is provided a dispenser with which lengths of a sheet material may be manually dispensed from a supply of the sheet material carried on the dispenser. A frame of the dispenser defines a passageway through which sheet material can be pulled from the dispenser. The dispenser also includes a cutting member having a sharp cutting edge adapted for transversely cutting the sheet material and having an elongate contact surface generally parallel to and spaced from that cutting edge. The cutting member is mounted on the frame along a first side of the passageway for movement relative to the frame between (1) a retracted position to which the cutting member is biased at which the cutting edge is spaced from the passageway and positioned to restrict contact between a person using the dispenser and the cutting edge, and at which retracted position the contact surface extends along the first side of the passageway; and (2) a cutting position to which the cutting member can be moved from its retracted position by manually tensioning sheet material being pulled from the dispenser around the contact surface of the cutting member. At the cutting position the cutting edge is positioned to intersect and transversely sever the tensioned sheet material.

The dispenser can be of the type called a masking machine or device, one embodiment of which is described in U.S. Pat. No. 4,990,214 wherein the first side of the passageway is defined by a first metal frame member removeably attached to another polymeric member of the frame. That first frame member includes a guide portion having an arcuate surface defining the first side of the passageway and a support portion projecting away from that guide portion and the passageway on the side of the guide portion opposite the supply of sheet material. The cutting member is mounted for pivotal movement between its retracted and cutting positions. The pivot axis of the cutting member is along the support portion of the first frame member; and in its retracted position the contact surface extends along the side of the passageway defined by the first frame member at a position spaced away from the passageway so that the sheet material must be tensioned in an arcuate path around both the guide surface and the contact surface to pivot the cutting member to its cutting position so that the cutting edge will intersect and transversely sever sheet material being pulled from the dispenser.

Alternatively, the dispenser can be of the type in which the frame has an elongate edge defining the first side of the passageway, and the cutting member can be mounted for pivotal movement between its retracted and cutting positions along that elongate edge so that in the retracted position of the cutting member its contact surface projects into the passageway and the sheet material can be tensioned in an arcuate path around only the contact surface to move the cutting member to its cutting position so that the cuffing edge will intersect and transversely sever the sheet material being pulled from the dispenser.

BRIEF DESCRIPTION OF THE DRAWING

The present invention will be further described with reference to the accompanying drawing wherein like reference numerals refer to like parts in the several views, and wherein:

FIGS. 2 and 3 are enlarged end views of the sheet cutting means according to the present invention on a fragment of the dispenser of FIG. 1 in which FIG. 2 illustrates a cutting member of the sheet cutting means in a normal retracted position, and FIG. 3 illustrates the cutting member in a cutting position so that illustrated sheet material can be cut;

FIGS. 5 and 6 are enlarged end views of the sheet cutting means according to the present invention on a fragment of the dispenser of FIG. 4 in which FIG. 5 illustrates a cutting member of the sheet cutting means in a normal retracted position, and FIG. 6 illustrates the cutting member in a cutting position so that illustrated sheet material can be cut;

FIGS. 7 and 8 are schematic cross sectional views of a dispenser including a third embodiment of the sheet cutting means according to the present invention in which FIG. 7 illustrates a cutting member of the sheet cutting means in a normal retracted position, and FIG. 8 illustrates the cutting member in a cutting position so that illustrated sheet material can be cut; and FIGS. 9 and 10 are schematic cross sectional views of a dispenser including a fourth embodiment of the sheet cutting means according to the present invention in which FIG. 9 illustrates a cutting member of the sheet cutting means in a normal retracted position, and FIG. 10 illustrates the cutting member in a cutting position so that illustrated sheet material can be cut.

DETAILED DESCRIPTION

Figure 1:
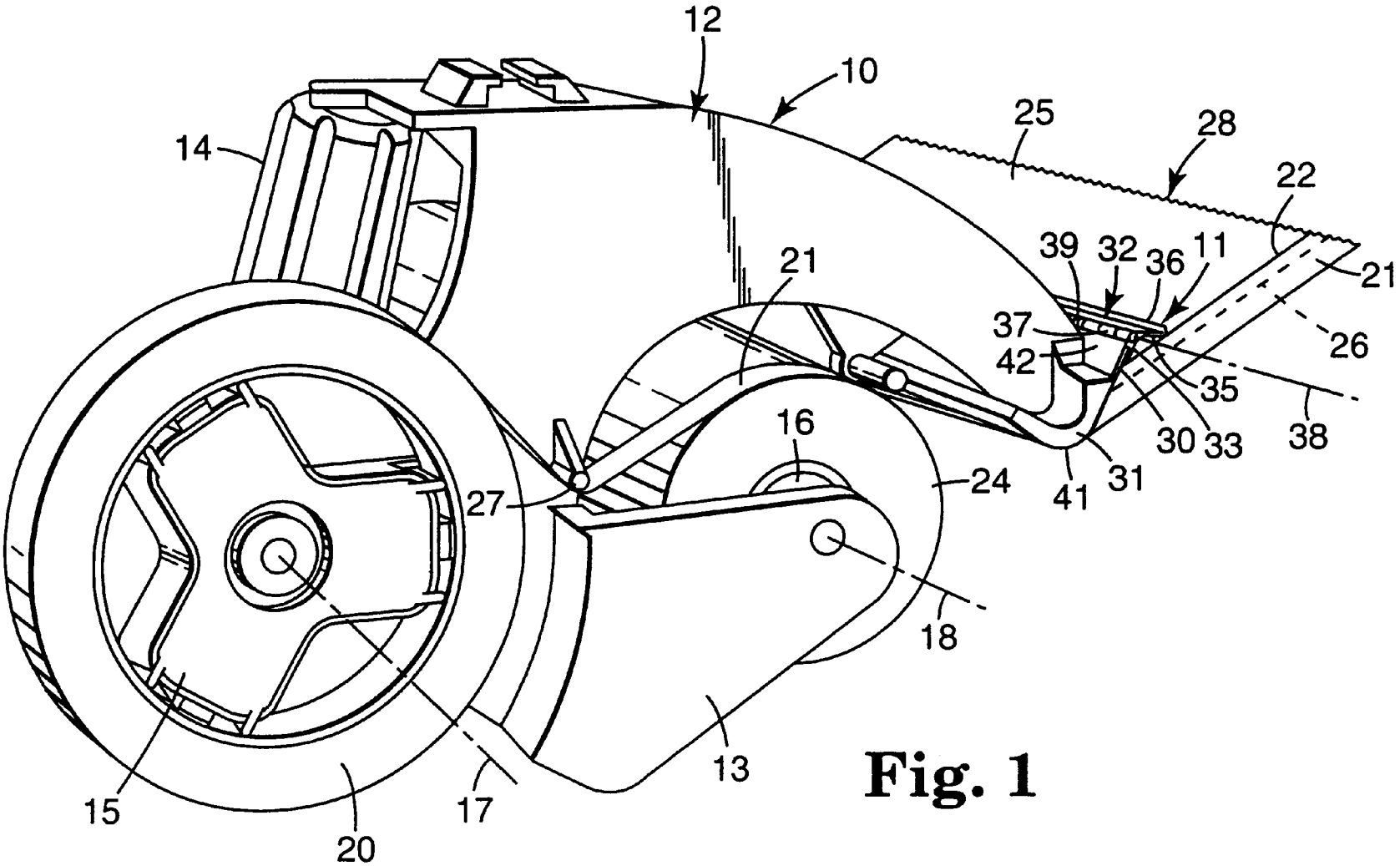
FIG. 1 is a perspective view of a first embodiment of a dispenser including sheet cutting means according to the present invention.
Figure 2:
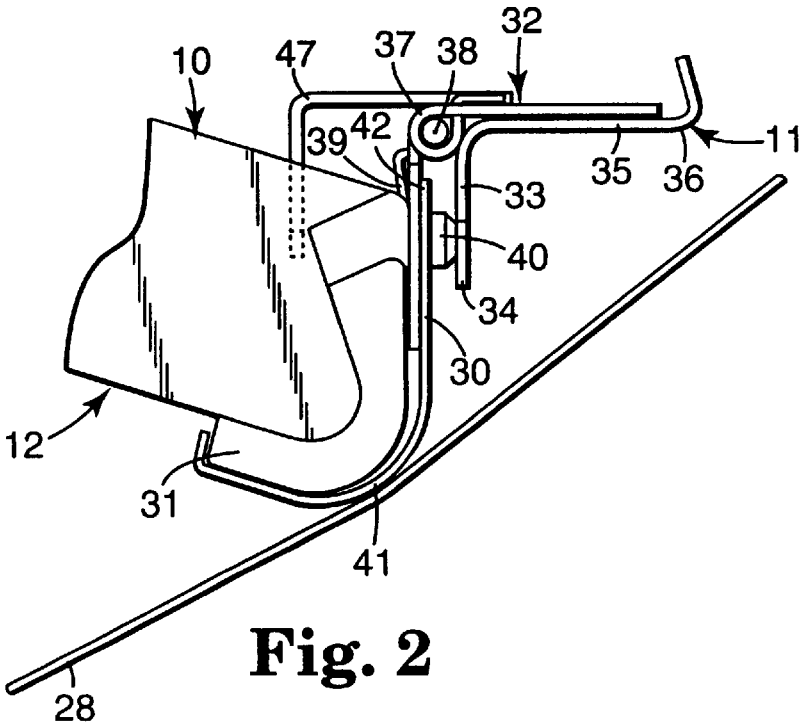
Figure 3:
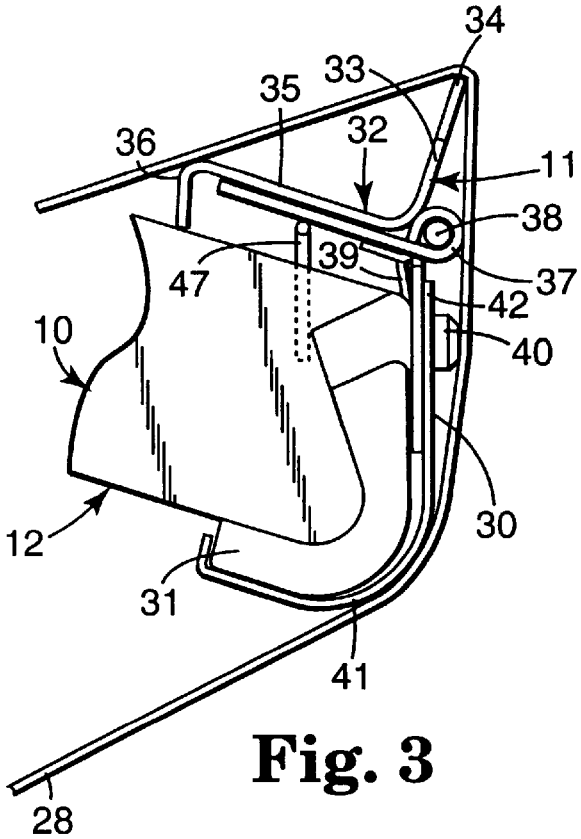

Referring now to FIGS. 1, 2 and 3 of the drawing, there is shown a dispenser 10 including sheet severing means 11 according to the present invention. The dispenser 10 is a type of dispenser called a masking machine or device that is described in U.S. Pat. No. 4,990,214 (the content whereof is incorporated herein by reference), one embodiment of which is sold by Minnesota Mining and Manufacturing Company, St., Paul, MN under the trade designation Hand-master (t.m.) M3X III Dispenser. Generally, that dispenser 10 includes a frame 12 comprising a polymeric portion including a hub support frame member 13 and a handle 14 adapted for manual engagement to manipulate the dispenser 10. First and second hubs 15 and 16 are mounted on the hub support frame member 13 for rotation about spaced generally parallel axes 17 and 18. The first hub 15 includes means for receiving a roll 20 of tape 21 and positioning a first edge 22 of a length of the tape 21 withdrawn from the roll 20 at a first predetermined position axially with respect to the first and second hubs 15 and 16 with the opposite second edge of that withdrawn length of tape 21 projecting past the frame 12 . The second hub 16 is adapted to receive a roll 24 of masking material 25 and to position a first edge 26 of the length of masking material 25 at a second predetermined position axially with respect to the first and second hubs 15 and 16 with the width of the length of tape 21 extending from the first position past the second position and the width of the length of masking material 25 extending from the second position past the first position. A portion of the length of tape 21 along the first edge 22 of the length of tape and a portion of the length of masking material 25 along the first edge 26 of the length of masking material 25 are both positioned between those first and second positions. The dispenser 10 includes means including a guide pin 27 that defines a path for the length of tape 21 from the roll 20 of tape 21 to the periphery of the roll 24 of masking material 25 where the portion of tape 21 along the first edge 22 of the length of tape 21 is adhered to the portion of the masking material 25 along the first edge 26 of the length of masking material 25. Such adhesion of the tape 21 to the masking material 25 along the periphery of the roll 24 of masking material 25 forms a composite masking sheet material 28 having opposite edges defined by the second edges of the length of tape 21 and the length of masking material 25 and an exposed portion of the coating of pressure sensitive adhesive along the second edge on the length of tape 21 along one major surface of the composite masking sheet material 28 so that the exposed portion of the coating of adhesive can be adhered along a surface to be masked to hold the composite masking sheet 28 in a desired position.

The frame 12 defines a passageway on the device 10 through which a person may pull the composite masking sheet material 28 from the supply of composite masking sheet material 28 formed at the periphery of the roll 24. The frame is formed by members including a first elongate frame member 30 of sheet metal (e.g., 0.018 inch thick steel) that has a generally J-shaped cross section and is removeably attached to another member 31 of the frame 12 included in the polymeric part thereof The first frame member 30 extends generally parallel to the axes 17 and 18 of the hubs 15 and 16 and defines a first side of the passageway. As is best seen in FIGS. 2 and 3, the dispenser 10 also includes an elongate cutting member 32 of sheet metal (e.g., also of 0.018 inch thick steel) that is generally L-shaped in cross section, has a blade portion 33 having a sharp cutting edge 34 adapted for transversely cutting the composite masking sheet material 28, and an activating portion 35 having an elongate contact surface 36 generally parallel to and spaced from the cutting edge 34. Means including a hinge assembly 37 (e.g., of the type called a "piano hinge") mounts the cutting member 32 on the first frame member 30 at the intersection of its blade and activating portions 33 and 35 for pivotal movement relative to the frame 12 about a cutting member pivot axis 38 generally parallel to and spaced from both the cutting edge 34, the contact surface 36, and the axes 17 and 18. That pivotal movement can be between (1) a retracted position illustrated in FIG. 2 to which the cutting member 32 is biased by spring means comprising two coil springs 39, and a cutting position illustrated in FIG. 3. In the retracted position (FIG. 2) the blade portion 33 and cutting edge 34 is along one of the side surfaces of the first frame member 30. That position of the cutting edge 34 restricts contact between the cutting edge 34 and a person using the dispenser 10. In the retracted position the contact surface 36 is spaced from and extends along the first side of the passageway defined by the first frame member 30. A user of the dispenser 10 can move the cutting member 32 from its retracted position to its cutting position by manually tensioning the composite masking sheet material 28 being pulled from the roll 24 around the contact surface 36 of the cutting member 32 (see FIG. 3). At that cutting position the blade portion 33 with its cutting edge 34 is spaced from the side surface of the first frame member 30 and the cutting edge 34 is positioned so that it will intersect and transversely sever the tensioned composite masking sheet material 28 as that composite masking sheet material 28 is pulled away from the dispenser 10.

The first sheet metal frame member 30 is removeably attached to the frame member 31 by means described in U.S. Pat. No. 4,990,214 which briefly comprises one side of one end portion the J-shaped elongate sheet metal frame member 30 being hooked around the member 31 of the polymeric part of the frame 12 that is adapted to fit in that end portion and to be retained in that end portion by a pin 40 that projects from the member 31 through an opening in the first frame member 30. The first sheet metal frame member 30 can be removed from the member 31 by manually pressing on the frame member 30 so that it resiliently bends and flexes over the pin 40, whereupon the member 30 can be unhooked from the member 31.

The first frame member 30 comprises a guide portion 41 having an arcuate surface defining the first side of the passageway through which the composite masking sheet material 28 is withdrawn, and a support portion 42 projecting away from the guide portion 41 and the passageway on the side of the guide portion 41 opposite the axis 18 of the roll 24. The side surface of the first frame member 30 against which the cutting edge 34 is positioned in the retracted position of the cutting member 32 is on the side of the support portion 42 opposite the axis 18 of the roll 24. The cutting member pivot axis 38 is along the support portion 42 of the first frame member 30. The cutting member pivot axis 38, the cutting edge 34, and the contact surface 36 are disposed such that in the cutting position of the cutting member 32 (see FIG. 3) the tensioned composite masking sheet material 28 extends from the supply of composite masking sheet material 28 on the dispenser 10 to the contact surface 36 with the cutting edge engaging the composite masking sheet material between the supply of composite masking sheet material on the dispenser 10 and the contact surface 36, and the cutting member 32 engages the tensioned composite masking sheet material 28 only at the contact surface 36 and at the cutting edge 34 until further tension applied on the composite masking sheet material 28 to withdraw it will cause the cutting edge 34 to penetrate and ultimately sever the composite masking sheet material 28.

In the retracted position of the cutting member 32 (seen in FIGS. 1 and 2 ) the contact surface 36 extends along the first side of the passageway defined by the first frame member 30 at a position spaced away from the passageway so that the composite masking sheet material 28 must be tensioned in an arcuate path around both the guide surface 41 and the contact surface 36 to move the blade portion 33 of the cutting member 32 away from the axis 18 of the roll 24 to its cutting position (seen in FIG. 3) so that the cutting edge 34 will intersect and transversely sever masking sheet material 28 being pulled from the dispenser 10.

The cutting edge 34 is provided by a plurality of similarly shaped teeth having generally in the shapes of triangles along the opposite surfaces of the blade portion 33 of the cutting member 32, which teeth have bases aligned in a first direction longitudinally along the blade portion 33 with the points of the teeth projecting in the same direction. Those teeth, which are similar to the teeth described in U.S. Pat. No. 4,913,767 (the content whereof is incorporated herein by reference), can pierce the composite masking sheet material 28 when the cutting member 32 is moved to its cutting position, so that further tension applied on the composite masking sheet material 28 will cause the teeth to further penetrate the composite masking sheet material 28 as a result of tension being applied to withdraw the composite masking sheet material 28 until the composite masking sheet material 28 is severed by the cutting edge 34.

Optionally, the contact surface 36 could be coated with a material such as a rubber or adhesive that would provide good frictional engagement between the composite masking sheet material 28 and the surface 36 when the composite masking sheet material 28 is tensioned around the contact surface 36 to move the cutting member 32 to its cutting position.

Also, optionally the dispenser 10 could include a manually operable safety or retaining member, such as the L-shaped retaining member 47, that has a pivot portion mounted on the frame 12 for rotation about its longitudinal axis through an angle of about 90 degrees between (1) a safe position (FIG. 2) at which a projecting portion of the L-shaped retaining member 47 overlays the cutting member 32 in its retracted position to prevent it from being moved to its cutting position; and (2) a release position (FIG. 3) at which the projecting end portion of the L-shaped retaining member 47 is parallel with the axis 38 and spaced from the cutting member 32 so that the cutting member 32 can be used as described above to cut the composite masking sheet material 28.

Figure 4:
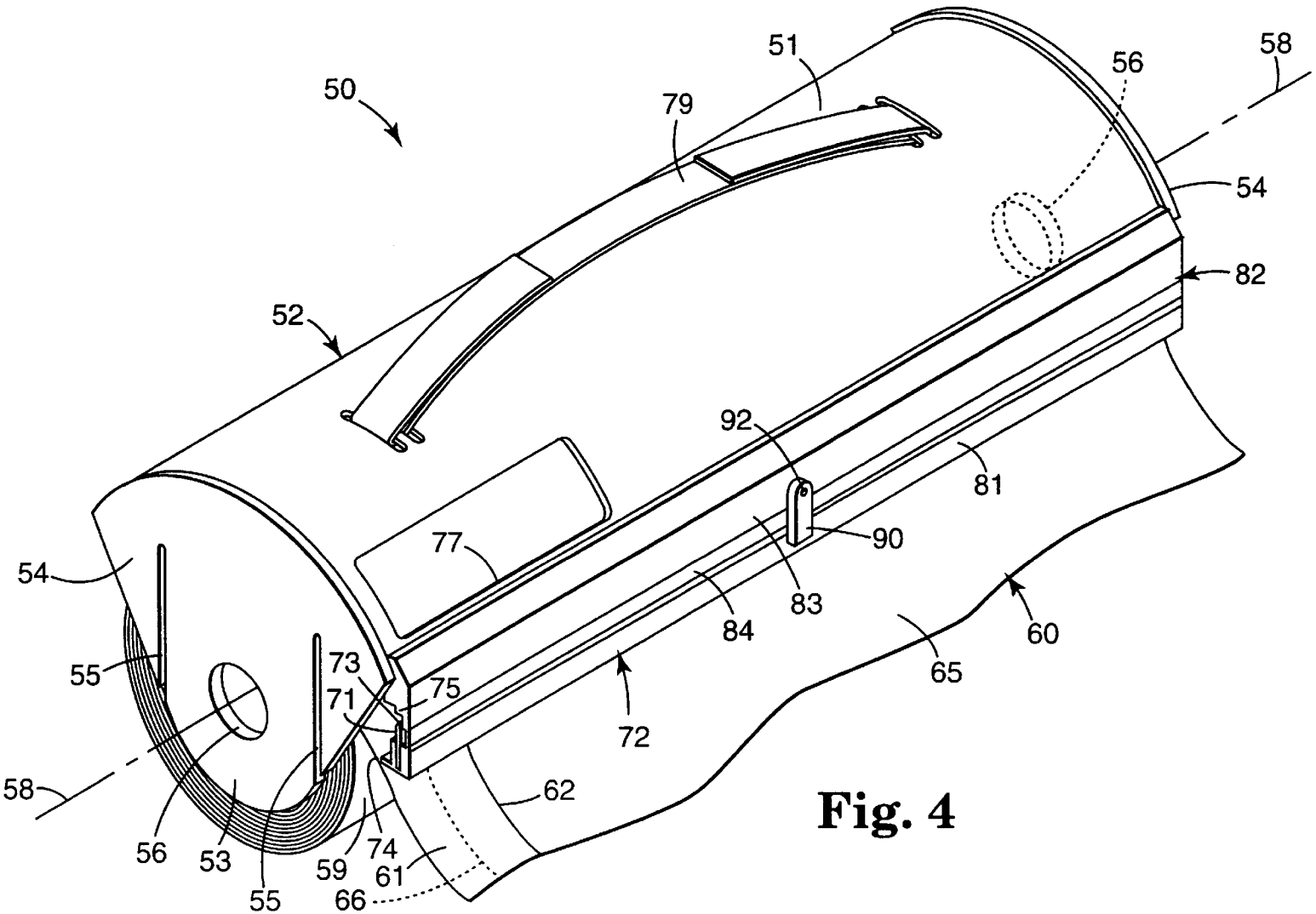
FIG. 4 is a perspective view of a second embodiment of a dispenser including sheet cutting means according to the present invention.
Figure 5:
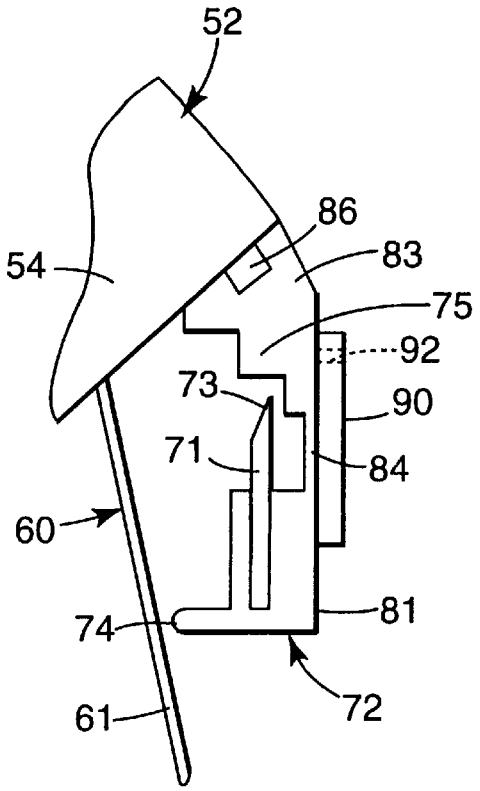
Figure 6:
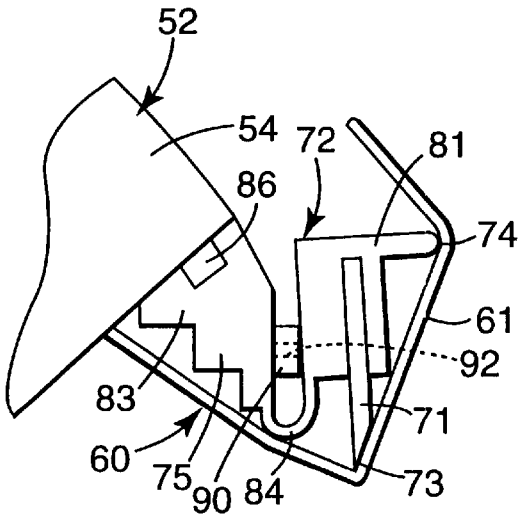

Referring now to FIGS. 4, 5, and 6 of the drawing, there is shown a dispenser 50 including sheet severing means according to the present invention. Generally, the dispenser 50 comprises a frame 52 made up of frame members including a semi-cylindrical frame member 51 that has an outer surface adapted for manual engagement to manipulate the dispenser 50, and parallel end wall frame members 54. Opposite ends of the semi-cylindrical frame member 51 are fixed as by an adhesive in opposed semi-circular grooves in the end wall frame members 54, and the end wall members 54 have spaced parallel slots 55 that define two spaced resiliently flexible hub support portions 53 at the opposite ends of the semi cylindrical frame member 51. Opposed cylindrical hubs 56 are fixed on the hub support portions 53 and are coaxial about an axis 58 that is also the axis of the semi-cylindrical member 51. The spaced hubs 56 are adapted for journaling opposite ends of the core in a supply roll 59 of composite masking sheet material 60 with the roll 59 in a cavity defined by inner surfaces of the frame 52. One or both of the hub support portions 53 can be resiliently flexed away from the other to afford inserting a roll 59 between or removing a core from the hubs 56. The composite masking sheet material 60 includes a length of tape 61 having a portion along a first edge 62 of the length of tape 61 adhered to a portion of a length of longitudinally folded polymeric film masking material 65 along a first edge 66 of the length of masking material 65 so that the composite masking sheet material 60 has opposite edges defined by second edges of the length of tape 61 and the length of masking material 65 opposite their first edges 62 and 66, and has an exposed portion of the coating of pressure sensitive adhesive along the second edge of the length of tape 61 along one major surface of the composite masking sheet material 60 so that the exposed portion of the coating of adhesive can be adhered along a surface to be masked to hold the composite masking sheet material 60 in a desired position.

The frame 52 defines a passageway through which a person may pull the composite masking sheet material 60 from the roll 59. The dispenser 50 includes a cutting member 72 including a blade 71 having a sharp cutting edge 73 (see FIG. 5) adapted for transversely cutting the composite masking sheet material 60. The cutting member 72 also includes an elongate contact surface 74 generally parallel to and spaced from the cutting edge 73. Means including hinge means (later to be explained) mounts the cutting member 72 on the frame 52 along a first side of the passageway for pivotal movement relative to the frame 52 about a cutting member pivot axis generally parallel to and spaced from the cutting edge 73, the contact surface 74 and the axis 58. That pivotal movement can be between (1) a retracted position illustrated in FIGS. 4 and 5 to which the cutting member 72 is biased by spring means (later to be explained), and (2) a cutting position illustrated in FIG. 6. In the retracted position the cutting edge 73 is spaced from the passageway and positioned along the inner surface of the frame 52 that defines the cavity for the roll 59, which position of the cutting edge 73 restricts contact between the cutting edge 73 and a person using the dispenser 50. The frame 52 includes a ledge 75 extending in closely spaced relationship along the sharp cutting edge 73 in a position adapted to further restrict contact with the sharp cutting edge 73 when the cutting member 72 is in its retracted position. In the retracted position of the cutting member 72 the contact surface 74 extends along the first side of the passageway defined by the frame 52. A user of the dispenser 50 can move the cutting member 72 from its retracted position to its cutting position by manually tensioning the composite masking sheet material 60 being pulled from the supply of the sheet material 60 in the dispenser 50 around the contact surface 74 of the cutting member 72. At that cutting position (see FIG. 6) the cutting edge 73 is along the first side of the passageway where it will intersect, pierce, and transversely sever the tensioned composite masking sheet material 60. Such tensioning of the composite masking sheet material 60 being pulled from the roll 59 around the contact surface 74 of the cutting member 72 is facilitated by an opening 77 through the arcuate frame member 51. A person holding the dispenser 50 with his or her right hand fingers projecting at generally a right angle to the axis 58 along the outer surface of the arcuate frame member 51 and beneath an adjustable length strap 79 having its ends attached at axially spaced positions along the frame member 51 with the palm of that hand on the side of the strap 79 adjacent the cutting member 72 can press his or her thumb through the opening 77 against the roll 59 to stop its rotation so that the person's other hand can pull on the composite masking sheet material 60 from the side of the cutting member 72 opposite the roll to cause the tension necessary to move the cutting member 72 from its retracted position (FIGS. 4 and 5 ) to its cutting position (FIG. 6) to then cut the composite masking sheet material 60 on the cutting edge 73.

The cutting member 72 comprises the elongate metal blade 71 on one side of which is the cutting edge 73, and a first part 81 of an elongate polymeric extrusion or member 82 that forms the contact surface 74, has a socket in which is fixed a side portion of the metal blade 71 opposite the cutting edge 73, and is joined by a thin section 84 of the polymeric extrusion 82 to a second attachment part 83 thereof which has an elongate slot that receives an edge portion 86 of the arcuate frame member 51. That edge portion 86 is attached to the attachment part 83 by means such as a suitable adhesive so that the attachment part 83 is a member of the frame 52. The thin section 84 of the polymeric extrusion provides both the hinge means (i.e., the hinge means being of the type often called a "living hinge") and, because of the resiliently flexible nature of the polymeric material, also provides the spring means for the cutting member 72. Alternatively, the arcuate frame member 51 could be extruded to include the polymeric extrusion 82 with the thin section 84 and the first part 81 that supports the blade 71 along its edge portion 86.

The elongate metal blade 71 is transversely corrugated along its length and has a ground planar surface along its length disposed at an angle to its side surfaces that forms the cutting edge 73 on a plurality of similarly shaped teeth generally in the shapes of triangles. Those teeth have bases aligned in a first direction longitudinally along the blade 71 with the points of the teeth projecting in the same direction. The points of the teeth can pierce the composite masking sheet material 60 when the cutting member 72 is moved away from the axis 58 to its cutting position, where the tensioned composite masking sheet material 60 extends from the supply of masking sheet material on the dispenser 50 to the contact surface 74 with the cutting edge 73 engaging the composite masking sheet material 60 between that supply of masking sheet material and the contact surface 74. The cutting member 72 engages the tensioned composite masking sheet material 60 only at the contact surface 74 and at the cutting edge 73 until further tension applied on the composite masking sheet material 60 to withdraw it will cause the teeth to further penetrate and ultimately sever the composite masking sheet material 60.

Optionally, the contact surface 74 could be made of (e.g., by co-extrusion) or coated with a material such as a rubber or an adhesive that would provide good frictional engagement between the composite masking sheet material 60 and the contact surface 74 when the composite masking sheet material 60 is tensioned around the contact surface 74 to move the cutting member 72 to its cutting position.

Also, optionally the dispenser 50 could include a manually operable safety or retaining member, such as the elongate safety or retaining member 90 that is mounted on the attachment part 83 of the extrusion 82 and is pivotable about an end pivotably mounted thereon at a pin 92 between a safe position (FIGS. 4 and 5) at which an end portion of the retaining member 90 opposite the pin 92 overlays the first part 81 of the extrusion 82 in the retracted position of the cutting member 72 to prevent it from being moved to its cutting position; and a release position (FIG. 6) at which the retaining member 90 is spaced from the first part 81 of the extrusion 82 so that the cutting member 72 can be used as described above to cut the composite masking sheet material 60.

Figure 7:
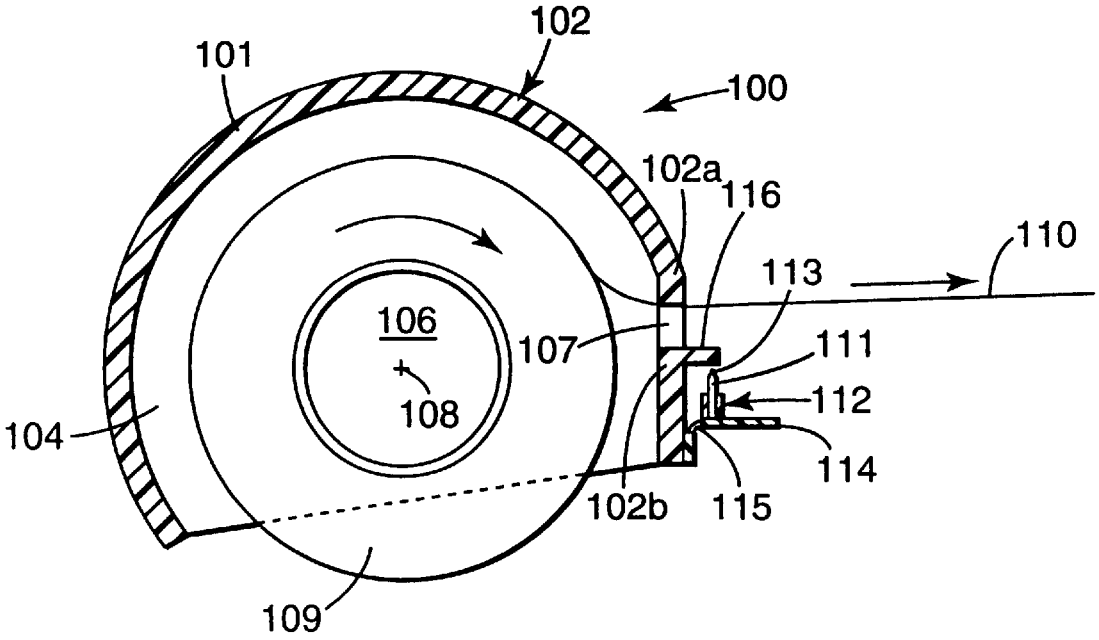
Figure 8:
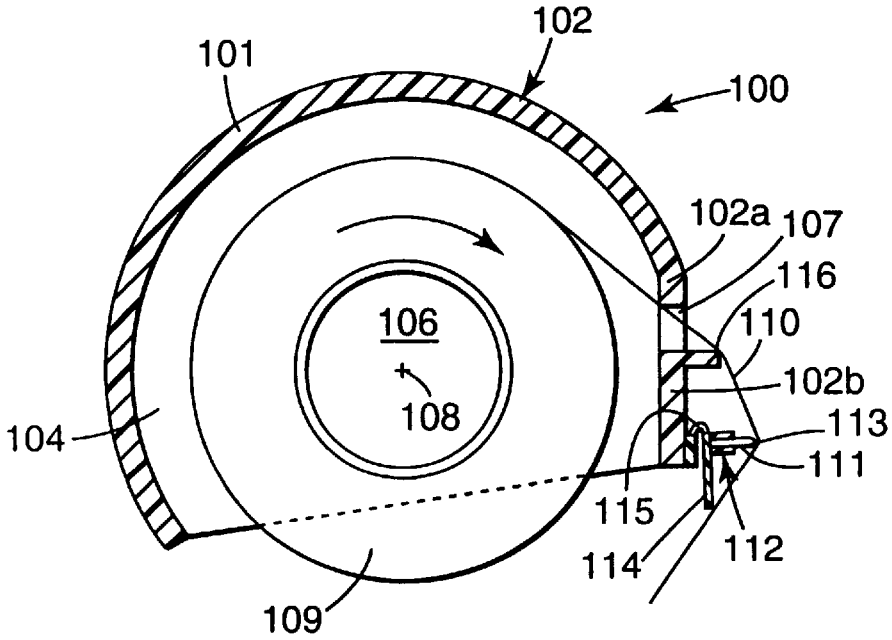

Referring now to FIGS. 7 and 8 of the drawing, there is shown a dispenser 100 including sheet severing means according to the present invention. Except for differences in the sheet severing means, the dispenser 100 could be similar to the dispenser 50 described above, and generally comprises a frame 102 made up of frame members including a semi-cylindrical frame member 101 that has an outer surface adapted for manual engagement to manipulate the dispenser 100, and parallel end wall frame members 104 (only one of which is shown) including spaced hubs 106 adapted for journaling opposite ends of the core in a supply roll 109 of sheet material 110 with the roll 109 in a cavity defined by inner surfaces of the frame 102 for rotation about an axis 108.

The frame 102 has closely spaced parts 102*a* and 102*b* that define a passageway 107 therebetween through which a person may pull the sheet material 110 from the roll 109. The dispenser 100 includes a cutting member 112 including a blade 111 having a sharp cutting edge 113 adapted for transversely cutting the sheet material 110. The cutting member 112 also includes an elongate contact surface 114 generally parallel to and spaced from the cutting edge 113. Means including hinge means in the form of a resiliently flexible strip 115 of polymeric material mounts the cutting member 112 on the part 102*b* of the frame 102 along a first side of the passageway 107 for pivotal movement relative to the frame 102 about a cutting member pivot axis generally parallel to and spaced from the cutting edge 113, the contact surface 114 and the axis 108. That pivotal movement can be between (1) a retracted position illustrated in FIG. 7 to which the cutting member 112 is biased by spring means provided by the resilient flexibility of the strip 115, and (2) a cutting position illustrated in FIG. 8. In the retracted position the cutting edge 113 is spaced from the passageway and positioned along the outer surface of the frame 102 adjacent a generally radially projecting ledge 116 on the frame 102 which restricts contact between a person using the dispenser 100 and the cutting edge 113. In the retracted position the contact surface 114 projects generally radially outwardly of the dispenser 100 along the first side of the passageway defined by the frame part 102*b* at a position spaced away from the passageway. A user of the dispenser 100 can move the cutting member 112 from its retracted position to its cutting position by manually tensioning the sheet material 110 being pulled from the supply of the sheet material 110 in the dispenser 100 in an arcuate path around the ledge 116 and the contact surface 114 of the cutting member 112. At that cutting position (see FIG. 8) the cutting edge 113 projects generally radially outwardly of the dispenser 100 along the first side of the passageway where it will intersect, pierce, and transversely sever the tensioned sheet material 110. Such tensioning of the sheet material 110 being pulled from the roll 109 around the ledge 116 and contact surface 114 of the cutting member 112 is facilitated by an opening (not shown) through the arcuate frame member 101. A person holding the dispenser 100 (as described above for the dispenser 50 ) can press his or her thumb through that opening against the roll 109 to stop its rotation so that the person's other hand can pull on the sheet material 110 from the side of the cutting member 112 opposite the roll 109 to cause the tension necessary to move the cutting member 112 from its retracted position (FIG. 7) to its cutting position (FIG. 8) to then cut the sheet material 110 on the cutting edge 113.

Figure 9:
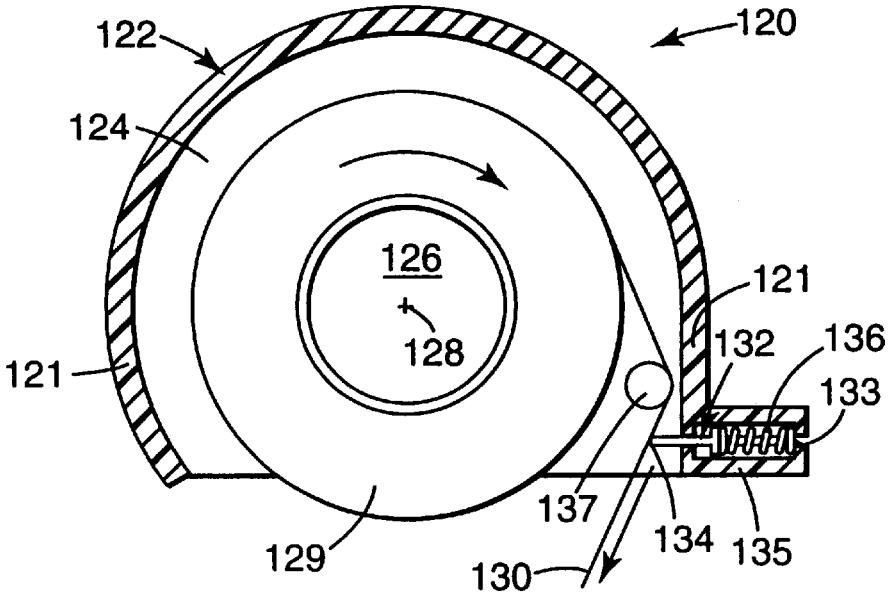
Figure 10:
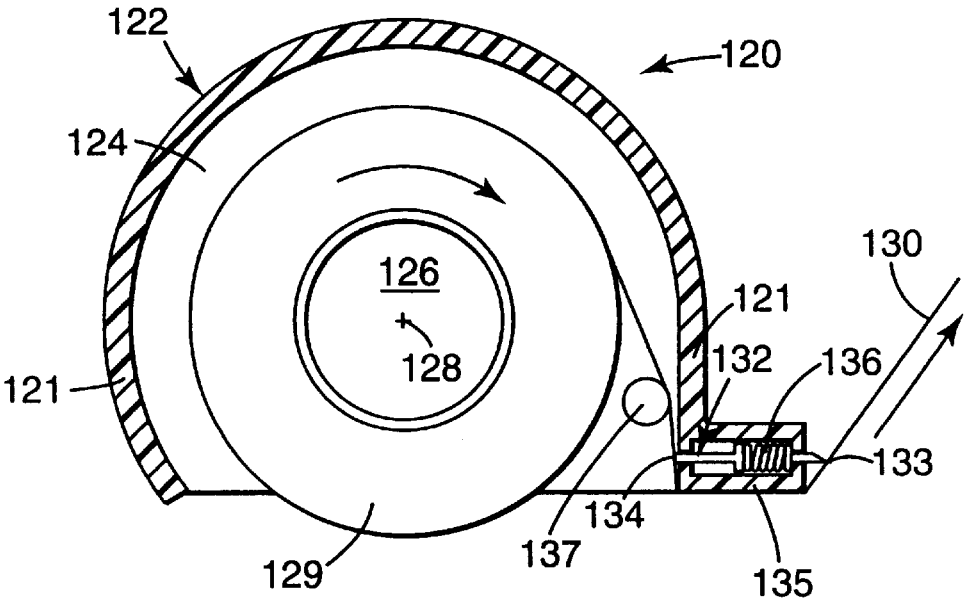

Referring now to FIGS. 9 and 10 of the drawing, there is shown a dispenser 120 including sheet severing means according to the present invention. Except for differences in the sheet severing means, the dispenser 120 could be similar to the dispenser 50 described above, and generally comprises a frame 122 made up of frame members including a semi-cylindrical frame member 121 that has an outer surface adapted for manual engagement to manipulate the dispenser 120, and parallel end wall frame members 124 (only one of which is shown) including spaced hubs 126 adapted for journaling opposite ends of the core in a supply roll 129 of sheet material 130 with the roll 129 in a cavity defined by inner surfaces of the frame 122 for rotation about an axis 128. The frame 122 defines a passageway through which a person may pull the sheet material 130 from the roll 129. The dispenser 120 includes a cutting member or blade 132 having a sharp cutting edge 133 adapted for transversely cutting the sheet material 130. The cutting member 132 also includes an elongate contact surface 134 generally parallel to and spaced from the cutting edge 133. Means including surfaces defining a slot through a thick edge portion 135 of the frame member 121 mounts the cutting member 132 on the frame 122 along a first side of the passageway for generally radial sliding movement relative to the frame 122 between (1) a retracted position illustrated in FIG. 9 to which the cutting member 132 is biased by coil springs 136, and (2) a cutting position illustrated in FIG. 10. In the retracted position the cutting edge 133 is spaced from the passageway and positioned within the slot in which it moves, thereby restricting contact between a person using the dispenser 120 and the cutting edge 133. In the retracted position the contact surface 134 projects generally radially inwardly of the dispenser 120 along the first side of the passageway defined by the frame 122. Sheet material 130 being pulled from the roll 129 is guided adjacent the contact surface 134 by a guide roller 137 journaled between the end walls 124 of the frame 122. A user of the dispenser 120 can move the cutting member 132 from its retracted position to its cutting position by manually tensioning the sheet material 130 being pulled from the roll 129 of sheet material 130 in the dispenser 120 in an arcuate path around the contact surface 134 of the cutting member 132 and the thick edge portion 135 of the frame member 121. At that cutting position (see FIG. 10) the cutting edge 133 projects outwardly of the dispenser 120 along the first side of the passageway where it will intersect, pierce, and transversely sever the tensioned sheet material 130. Such tensioning of the sheet material 130 being pulled from the roll 129 around the contact surface 134 of the cutting member 132 and the thick edge portion 135 of the frame member 121 is facilitated by an opening (not shown) through the arcuate frame member 121. A person holding the dispenser 120 (as described above for the dispenser 50 ) can press his or her thumb through that opening against the roll 129 to stop its rotation so that the person's other hand can pull on the sheet material 130 from the side of the cutting member 132 opposite the roll 129 to cause the tension necessary to move the cutting member 132 from its retracted position (FIG. 9) to its cutting position (FIG. 10) and to then cut the sheet material 130 on the cuffing edge 133.

The present invention has now been described with reference to four embodiments thereof. It will be apparent to those skilled in the art that many changes can be made in the embodiments described without departing from the scope of the present invention. For example, the sheet material can be a composite of two materials (i.e., adhesive coated tape and polymeric film) as described above with reference to the dispensers 10 and 50, or could be single sheets of any material such as paper, thin metal, cloth, polymeric material (e.g., film, woven or nonwoven fibers) or combinations thereof, which sheets may or may not be coated with a material such as pressure sensitive adhesive (i.e., adhesive tape) or an abrasive (i.e., sandpaper). Also, the cutting edge can be formed on spaced teeth as described above, or alternatively could be any other cutting edge, such as a straight sharp cutting edge of the type used on a razor blade. Thus, the scope of the present invention should not be limited to the structures and methods described in this application, but only by the structures and method described by the language of the claims and the equivalents thereof.

We claim:

1. A dispenser from which sheet material having opposite major surfaces may be manually dispensed, said dispenser comprising:

a frame;

means on said frame adapted for carrying the sheet material and for defining a passageway having a first side generally parallel to said surfaces of said sheet material, through a portion of which passageway a portion of the sheet material carried on the frame can be pulled;

a cutting member having a sharp cutting edge adapted for transversely cutting the sheet material and an elongate contact surface generally parallel to and spaced from said cutting edge;

means mounting said cutting member on said frame along said first side of and transverse to said passageway for movement relative to said frame between:

a) a retracted position at which said cutting edge is spaced from said passageway and positioned to restrict contact between a person using the dispenser and said cutting edge, and at which retracted position said contact surface extends along said first side of said passageway, and b) a cutting position to which the cutting member can be moved from said retracted position by manually tensioning the sheet material being pulled from the dispenser around the contact surface of the cutting member, at which cutting position said cutting edge is positioned to intersect and transversely sever the tensioned sheet material; and means for biasing said cutting member to said retracted position;

said means mounting said cutting member on said frame mounting said cutting member for pivotal movement relative to said frame about a cutting member pivot axis generally parallel to and spaced from both said contact surface and said cutting edge between said retracted and cutting positions; and said contact surface being disposed so that when said cutting member is moved to said cutting position by said tensioned sheet material said tensioned sheet material extends from the sheet material carried on said frame to said contact surface with said cutting edge engaging said sheet material therebetween; and at least a portion of said frame and at least a portion of said cutting member being provided by a unitary polymeric molding having an elongate relatively thin resiliently flexible section between said frame and said cutting member providing both said means for mounting said cutting member on said frame for pivotal movement and said means for biasing.

2. A dispenser according to claim 1 wherein said dispenser engages the portion of the sheet material being pulled from the sheet material carried on the frame only at said contact surface and at said cutting edge.

3. A dispenser according to claim 1 wherein:

said frame comprises a plurality of frame members including a first frame member removeably attached to other of said frame members, said first frame member comprises a guide portion having an arcuate surface defining said first side of said passageway and a support portion projecting away from said guide portion and said passageway on the side of said guide portion opposite said sheet material on the frame;

said cutting member pivot axis is along said support portion of said first frame member; and in said retracted position said contact surface extends along said side of said passageway defined by said first frame member at a position spaced away from said passageway so that said sheet material must be tensioned in an arcuate path around both said guide surface and said contact surface to move said cutting member to said cutting position.

4. A dispenser according to claim 1 wherein:

said frame has a distal edge defining said one side of said passageway;

said cutting member pivot axis is along said distal edge; and in said retracted position said contact surface extends along said one side of said passageway defined by said first frame member at a position projecting into said passageway so that said sheet material can be tensioned in an arcuate path around said contact surface to move said cutting member to said cutting position.

5. A dispenser according to claim 1 wherein:

said frame has a distal edge defining said one side of said passageway;

said cutting member pivot axis is spaced from, said distal edge; and in said retracted position said contact surface projects away from said dispenser and extends along said side of said passageway defined by said first frame member at a position spaced away from said passageway so that said sheet material must be tensioned in an arcuate path around said contact surface to move said cutting member to said cutting position.

6. A dispenser according to claim 1 wherein said frame includes a ledge extending along said sharp cutting edge in a position adapted to restrict contact with said sharp cutting edge when said cutting member is in said retracted position.

7. A dispenser according to claim 1 further including a retaining member mounted on said frame for movement between an engaged position at which said retaining member engages and retains said cutting member in said retracted position, and a released position at which said retaining member affords movement of said cutting member between said retracted and said cutting positions.

8. A cutting member assembly for use on a dispenser from which sheet material having major opposite surfaces may be dispensed, said dispenser comprising a frame, and means for carrying the supply of sheet material on the frame; said frame including frame members defining a passageway through which a person may pull a portion of the sheet material, said frame members including a first frame member having opposite side surfaces, said first frame member extending generally parallel to the major surfaces of the sheet material and defining one side of the passageway; said cutting member assembly comprising; a cutting member having a sharp cutting edge adapted for transversely cutting the sheet material and an elongate contact surface generally parallel to and spaced from said cutting edge;

means adapted for mounting said cutting member on the first frame member for movement relative to said frame between a) a retracted position at which said cutting edge is along said first frame member to restrict contact between a person using the dispenser and said cutting edge and said contact surface extends along said one side of said passageway defined by said first frame member, and b) a cutting position to which the cutting member can be moved from said retracted position by manually tensioning the sheet material being pulled from the dispenser around the contact surface of the cutting member, at which cutting position said cutting edge is spaced from said one side surface of said first frame member and is positioned to intersect and transversely sever the tensioned sheet material; and means for biasing said cutting member to said retracted position;

said means mounting said cutting member on said frame mounting said cutting member for pivotal movement relative to said frame about a cutting member pivot axis generally parallel to and spaced from both said contact surface and said cutting edge between said retracted and cutting positions; and said contact surface being disposed so that when said cutting member is moved to said cutting position by said tensioned sheet material said tensioned sheet material extends from the sheet material carried on said frame to said contact surface with said cutting edge engaging said sheet material therebetween; and at least a portion of said cutting member and at least a portion of said first frame member being provided by a unitary polymeric molding having an elongate relatively thin resiliently flexible section between said first frame member and said cutting member providing both said means for mounting said cutting member on said first frame member for pivotal movement and said means for biasing.

9. A cutting member assembly according to claim 8 wherein said contact surface is adapted to be disposed so that said dispenser engages the portion of the sheet material being pulled from the sheet material carried on the frame only at said contact surface and at said cutting edge.

10. A cutting member assembly according to claim 8 wherein:

said first frame member is included in said cutting member assembly and is removeably attached to other of said frame members, and said first frame member comprises a guide portion having an arcuate surface defining said one side of said passageway and a support portion projecting away from said guide portion and said passageway on the side of said guide portion opposite said sheet material carried on the frame;

said cutting member pivot axis is along said support portion of said first frame member; and in said retracted position said contact surface extends along said one side of said passageway defined by said first frame member at a position spaced away from said passageway so that said sheet material must be tensioned in an arcuate path around both guide surface and said contact surface to move said cutting member to said cutting position.

11. A cutting assembly according to claim 8 wherein:

said first frame member has a distal edge defining said one side of said passageway with said one side surface of said first frame member being on the side of said support portion adjacent said sheet material axis;

said cutting member pivot axis is along said distal edge; and in said retracted position said contact surface extends along said one side of said passageway defined by said first frame member at a position projecting into said passageway so that said sheet material can be tensioned in an arcuate path around said contact surface to move said cutting member to said cutting position.

12. A dispenser with which sheet material may be manually dispensed from a helically wound roll of the sheet material, said dispenser comprising:

a frame;

means for mounting the roll of sheet material on said frame for rotation relative to the frame about a predetermined sheet material axis;

said frame including frame members defining a passageway through a portion of which passageway a person may pull sheet material being dispensed from the roll of sheet material, said frame members including a first frame member having opposite side surfaces, said first frame member extending generally parallel to the axis and defining one side of the passageway, and;

a cutting member having a sharp cutting edge adapted for transversely cutting the sheet material in the roll and an elongate contact surface generally parallel to and spaced from said cutting edge;

means mounting said cutting member on the first frame member for pivotal movement relative to said frame about a cutting member pivot axis generally parallel to and spaced from both said cutting edge and said contact surface between (1) a retracted position at which said cutting edge is along one of said side surfaces of said first frame member to restrict contact between a person using the dispenser and said cutting edge and said contact surface extends along said one side of said passageway defined by said first frame member; and 2) a cutting position to which the cutting member can be moved from said retracted position by manually tensioning sheet material being pulled from the roll of sheet material around the contact surface of the cutting member, at which cutting position said cutting edge is spaced from said one side surface of said first frame member and is positioned to intersect and transversely sever the tensioned sheet material; and means for biasing said cutting member to said retracted position;

at least a portion of said first frame member and at least a portion of said cutting member being a unitary polymeric molding having an elongate relatively thin resiliently flexible section between said first frame member and said cutting member providing both said means for mounting said cutting member on said first frame member for pivotal movement and said means for biasing.

* * * * *